United States Patent [19]

Hashimoto et al.

[11] Patent Number: 4,493,573

[45] Date of Patent: Jan. 15, 1985

[54] PRINTING APPARATUS

[75] Inventors: Masanori Hashimoto, Yokohama; Shunichi Ogawa, Hatano, both of Japan

[73] Assignee: Ricoh Company, Ltd., Japan

[21] Appl. No.: 476,222

[22] Filed: Mar. 17, 1983

[30] Foreign Application Priority Data

Mar. 19, 1982 [JP] Japan ..... 57-42831
Mar. 26, 1982 [JP] Japan ..... 57-41841

[51] Int. Cl.[3] ..... B41J 13/14; B41J 29/10

[52] U.S. Cl. ..... 400/647.1; 400/690.1; 400/690.4; 400/692

[58] Field of Search ..... 400/690.4, 689, 690, 400/690.1, 690.2, 690.3, 692, 693, 605, 647.1

[56] References Cited

U.S. PATENT DOCUMENTS 850,890 4/1907 McCormack ..... 400/647.1 X
2,351,854 6/1944 Hall ..... 400/603 X
3,513,938 5/1970 Buehner et al. ..... 400/609.1 X

FOREIGN PATENT DOCUMENTS 2076744 12/1981 United Kingdom ..... 400/690.1

OTHER PUBLICATIONS

IBM Technical Disclosure Bulletin vol. 24, No. 8, Jan. 1982, p. 4101, "Acoustic Cover" by Meister, Jr.

*Primary Examiner*—Paul T. Sewell
*Assistant Examiner*—Charles A. Pearson
*Attorney, Agent, or Firm*—Guy W. Shoup

[57] ABSTRACT

A printing apparatus including a printing sheet guide for supporting a single printing sheet, a page feeder for successively feeding a plurality of continuous sheets to a printing section, and a sound absorber and a noise silencing cover for avoiding release of noise to outside. The printing apparatus has a front cover located forwardly of an upper cover for a printer body for movement between an open position and a closed position, and a pair of brackets are inserted in engaging holes formed on opposite sides of the upper cover. The printing sheet guide and the noise silencing cover are detachably attached to the brackets, and the page feeder includes engaging portions located on opposite sides which are inserted in positions at the front cover outwardly of the sound absorber and the noise silencing cover and inwardly of hinged portions on opposite sides of the front cover to be releasably brought into engagement with a platen shaft. The front cover is brought to an open position without removing any of the optionally mounted components.

4 Claims, 22 Drawing Figures

(A)

(B)

PRINTING APPARATUS

BACKGROUND OF THE INVENTION

This invention relates to a printing apparatus, and more particularly it is concerned with improvements in or relating to an optional components mounting mechanism of a printing apparatus.

Generally, a printing apparatus has components that are optionally mounted, such as a printing sheet guide for supporting a single sheet that is inserted, a page feeder for successively feeding a set of sheets arranged continuously, etc. In a printing apparatus of the type generally referred to as an impact printer wherein printing types are struck with a hammer when printing is performed, a sound absorber or a noise silencing cover may optionally be mounted for avoiding making a noise.

Printing apparatus of the prior art have suffered, however, the disadvantage that if at least one of the sound absorber, noise silencing cover and printing sheet guide is mounted, then it is impossible to mount the page feeder. When it is necessary to mount the page feeder, it is necessary to dismount the sound absorber, noise silencing cover and printing sheet guide, and this is troublesome and makes one wonder where the removed components should be placed. To avoid this trouble, attempts have been made to produce two types of printing apparatus, one type being adapted to mount the sound absorber, noise silencing cover and printing sheet guide and the other type being intended to mount the page feeder. Also, some printing apparatus have had the page feeder and the noise silencing cover attached thereto, which became so large in size that separate printing apparatus have been produced merely for mounting the printing sheet guide. In the type of printing apparatus mounting the page feeder, one has to remove the noise silencing cover and a front cover of the printing apparatus when the ribbon and printing wheels are replaced by new ones, and one has to remove the page feeder each time the ribbon and printing wheel are replaced by new ones, depending on the type of printing apparatus. Opening and closing the noise silencing cover and front cover have tended to cause abnormal conditions to be produced in the printing apparatus in which the sheet in the process of setting might be folded or wound on the platen, making it inevitable to reinsert the sheet into the printing apparatus.

Printing apparatus adapted to mount optionally the page feeder for feeding into the printing section sheets arranged continuously in a set might be constructed such that when the page feeder is mounted, left and right side frames of the page feeder penetrate a printer cover and are brought into engagement with engaging portions in the interior. When this type of printing apparatus has no page feeder mounted thereon, the page feeder mounting portions (portions where the frames penetrate the printer cover) of the printer cover would be left open to allow the engaging portions and gears in the interior to be exposed to view. When this is the case, the operator might be tempted to put fingers into the openings or the fingers might actually be injured by mistake. In the impact type printing apparatus, sound is produced each time printing is performed, so that it is usual practice to cover the printing section with the sound absorber or noise silencing cover to avoid release of noise to the outside. However, noise might be emitted through the openings of the page feeder mounting portion unless the openings are closed.

SUMMARY OF THE INVENTION

This invention has been developed for the purpose of obviating the aforesaid disadvantages of the prior art. Accordingly the invention has, as one of its objects, the provision of a printing apparatus capable of mounting a page feeder irrespective of whether or not a sound absorber, a noise silencing cover and a printing sheet guide are already mounted. The invention allows the front cover, when all the aforesaid components have all been mounted, to be opened to replace the ribbon and/or the printing wheel set in the printing apparatus, without requiring removal of the optional components already mounted.

Another object is to provide a printing apparatus including blind plates detachably attached to the page feeder mounting portions of a front cover, the blind cover being left in place when no page feeder is mounted and removed from its position when the page feeder is mounted.

To accomplish the aforesaid first object, there is provided according to the invention a printing apparatus comprising an upper cover secured to a printer body, a front cover detachably attached to the printer body in a position forwardly of the upper cover in such a manner that it can be freely opened and closed, and a platen interposed between the upper cover and the front cover. The printing apparatus is adapted to optionally mount a pair of brackets, sound absorber, a printing sheet guide, a noise silencing cover and a page feeder. The pair of brackets are each removably inserted in one of two engaging holes formed on opposite sides of the upper cover. The sound absorber is detachably inserted along the platen. The printing sheet guide releasably brought into engagement at corners on opposite sides with first engaging portions of the brackets located on inner sides thereof so that the printing sheet guide can be set in a predetermined position or brought to a lying position when not in use. The noise silencing cover is releasably brought into engagement at forward ends of arms located on opposite sides with second engaging portions of the brackets located on outer sides thereof to thereby cover a printing section in a manner to be freely opened and closed. The page feeder includes engaging portions located on opposite sides which are inserted in positions at the front cover outwardly of the sound absorber and the noise silencing cover and inwardly of hinged portions on opposite sides of the front cover in such a manner that they are releasably brought into engagement with a shaft of the platen. The components optionally mounted on the printing apparatus can be mounted either singly or plurally in any arbitrarily selected combination as desired and the front cover can be opened without removing the optionally mounted component or components for replacing a ribbon or a printing wheel with a new one.

To accomplish the aforesaid second object, there is provided according to the invention a printing apparatus comprising a pair of blind plates each detachably attached to one of two page feeder mounting portions of the front cover in such a manner that they can be removed when the page feeder is mounted.

Additional and other objects, features and advantages of the invention will become apparent from the description set forth hereinafter when considered in conjunction with the accompanying drawings.

DETAILED DESCRIPTION OF THE PREFERRED EMBODIMENTS

Figure 1:
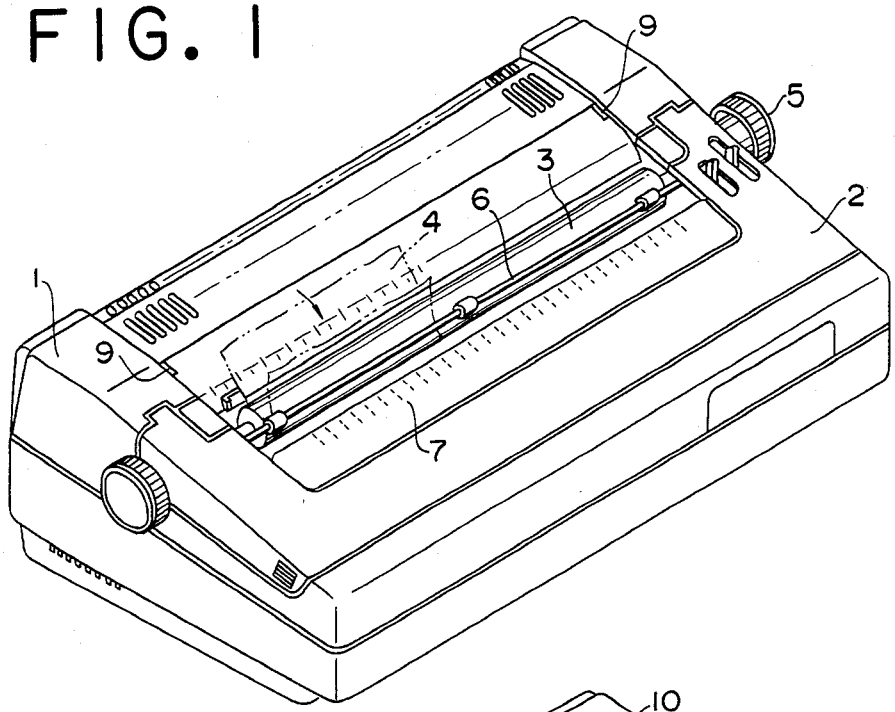
FIG. 1 is a perspective view of the printing apparatus comprising one embodiment of the invention, having no component optionally mounted thereon.

Embodiments of the invention will now be described by referring to the accompanying drawings. Referring to FIG. 1, there is shown an impact printing apparatus according to the invention which has no optional components mounted thereon. The impact printing apparatus comprises an upper cover 1 secured to a printer body and formed of grafted polyphenylene ether resin, a front cover 2 formed of the same material as the upper cover attached to the printer body in a position forwardly of the upper cover 1 in such a manner that the front cover 2 can be freely opened and closed, and a platen 3 interposed between the upper cover 1 and the front cover 2. A printing sheet 4 is inserted in the direction of an arrow and set in position by turning a knob 5. In the case of a printing apparatus, printing is usually started at the start position at the left end portion of the sheet regardless of its size. The numeral 6 designates a bail shaft for keeping the printing sheet 4 down, and the numeral 7 designates a character scale.

Figure 2:
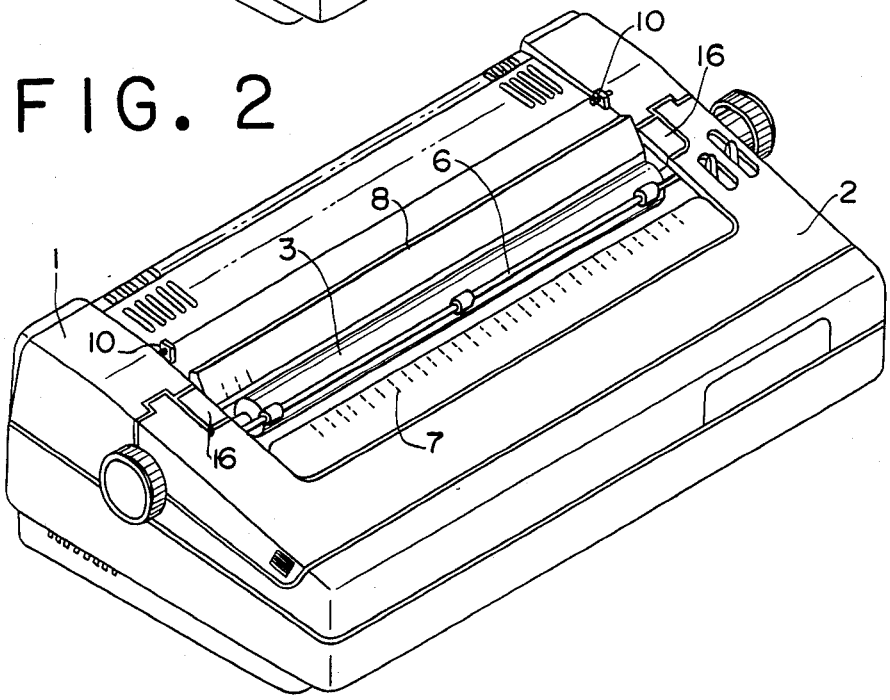
FIG. 2 is a perspective view of the printing apparatus shown in FIG. 1, having a sound absorber and brackets attached thereto.

FIG. 2 shows the impact printing apparatus shown in FIG. 1, which further mounts a sound absorber 8 detachably attached along the platen 3, and the pair of brackets 10 each removably inserted in one of engaging holes 9 (see FIG. 1) formed on opposite sides or left and right sides of the upper cover 1.

Figure 6:
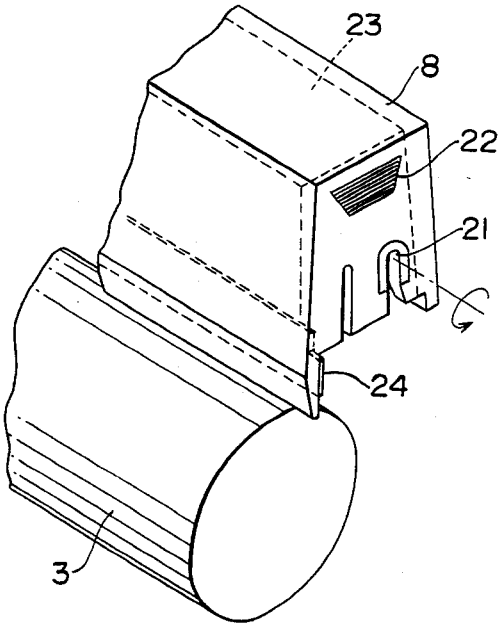
FIG. 6 is perspective view of the sound absorber, showing its construction.

The sound absorber 8 made as of an ABS resin is formed, as shown in FIG. 6, at opposite ends thereof with receiving openings 21 of a shape of an inverted letter U which are adapted to have snugly fitted therein projections formed on the printer body by utilizing the resilience of the material, to thereby attach the sound absorber 8 in place. The sound absorber 8 is also formed in upper portions of its opposite sides with knurled surfaces 22 that can be gripped by the operator to pull the sound absorber 8 out of engagement with the printer body to remove same, and has a sound absorbing material 23, such as polyester foam, stuffed in its interior. When the sound absorber 8 is in its position on the printer body, the sound absorber 8 is preferably held in position while one end portion thereof is in contact with the platen 3 to facilitate absorbing sound and inserting a printing sheet. To this end, a weight 24 is secured to the sound absorber 8 to allow a moment of rotation oriented in the direction of an arrow to be produced at all times with respect to its support axis.

Figure 7:
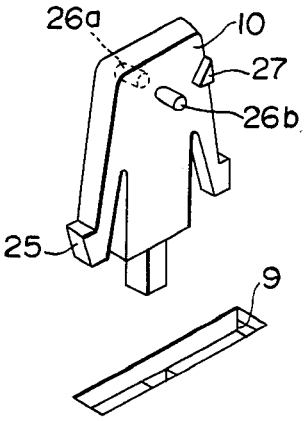
FIG. 7 is a perspective view of the bracket, showing its construction.

The brackets 10 made as of a polyacetal resin are each formed, as shown in FIG. 7, with a pair of resilient claws 25 located on opposite sides or front and rear sides and are adapted to be snugly fitted in one of the engaging holes 9 formed in the upper cover 1 to be secured in place on the printer body and readily removed if so desired. Each bracket 10 is formed on opposite sides with engaging pins **26*a* and 26*b*** with which a printing sheet guide and a noise silencing cover are brought into engagement, to be thereby held in place.

Figure 3:
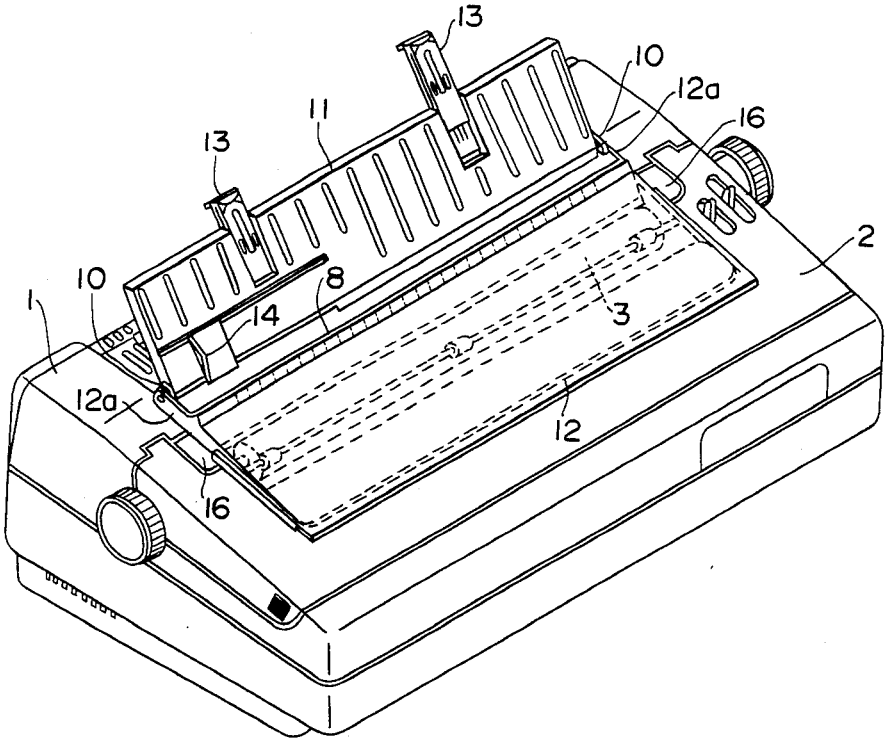
FIG. 3 is a perspective view of the printing apparatus shown in FIG. 2, having a printing sheet guide and a noise silencing cover mounted thereon.

FIG. 3 shows the printing apparatus shown in FIG. 2 which further mounts the printing sheet guide 11 for guiding the insertion of a copying sheet and the noise silencing cover 12. The printing sheet guide 11 is formed in corners at opposite ends with engaging openings which are partly cut out and are adapted to receive therein the inner engaging pins **26*a* of the brackets 10, to attach the guide 11 to the printer body. The noise silencing cover 12 is formed at forward ends of arms 12*a* on opposite sides with engaging openings which receive, by utilizing the resilience of the arms 12*a*, the outer engaging pins 26*b* of the brackets 10, to attach the upper cover 1 to the printer body. Thus the printing sheet guide 11 and noise silencing cover 12 can be releasably brought into engagement with the brackets 10 fitted on opposite sides of the upper cover 1 and can be pivoted about the engaging portions of the brackets 10. The noise silencing cover 12 is transparent and cooperates with the sound absorber 8 to provide a shield to a printing section of the apparatus to avoid noise being released to the outside. The printing sheet guide 11 has attached to its back folding legs, not shown, which are set at an optimum angle for inserting a printing sheet and can be brought to a lying position when not in use. The numeral 27 in FIG. 7 designates a stopper for holding the noise silencing cover 12 when the latter is lifted and bent toward the printing sheet guide 11**.

Figure 8:
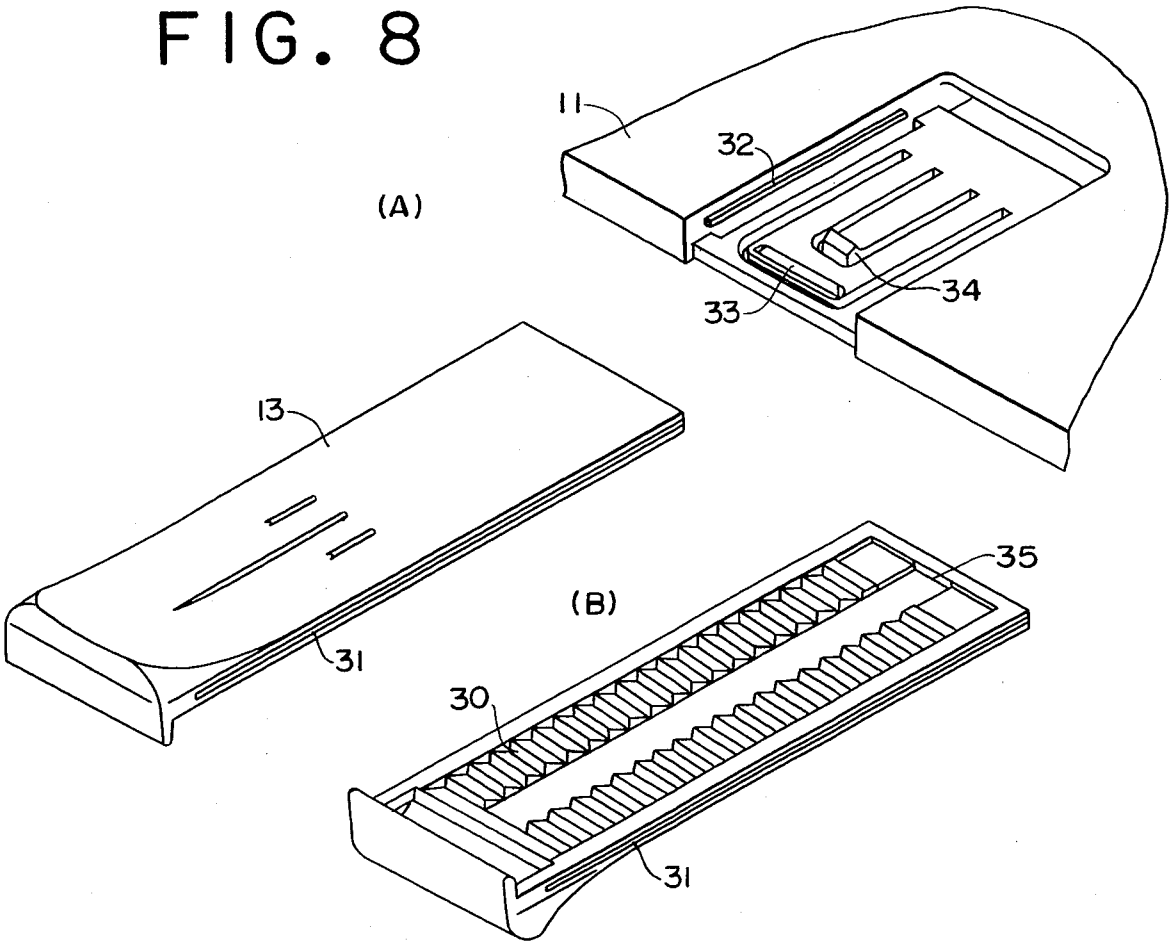
FIG. 8 is a view showing the construction of the extension guide and the mounting mechanism therefor.

The printing sheet guide 11 will be described further in detail. The guide 11 includes an extension guide 13 formed as of an ABS resin which can be telescopically extended when necessary. As shown in FIG. 8, the extension guide 13 is formed with two rows of angled projections 30 at its bottom surface and grooves 31 on opposite side surfaces. When the extension guide 13 is inserted in the printing sheet guide 11 by fitting projections 32 on the guide 11 in the grooves 31, the angled projections 30 can be brought into engagement with a resilient pawl 33 formed on the printing sheet guide 11 to enable the extension guide 13 to be held in any extended position as desired. When the extension guide 13 is withdrawn from the guide 11 to its outermost position, another resilient pawl 34 is brought into engagement with a final offset portion 35 of the extension guide 13 to prevent the extension guide 13 from being released from engagement with the printing sheet guide 11. When the extension guide 13 is inserted in the guide 11 to its innermost position, a portion of the former underlies the bottom surface of the latter and is hidden from the view. The numeral 14 in FIG. 3 designates a slidable positioning guide for regulating the position of an end portion of a printing sheet to be set in position.

Figure 9:
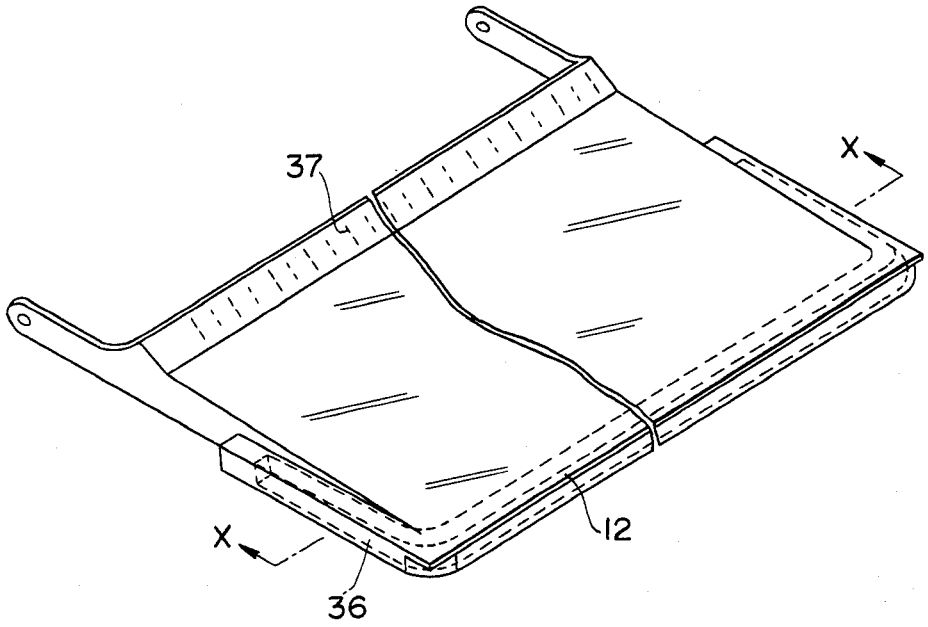
FIG. 9 is a view of the construction of the noise silencing cover.
Figure 9:
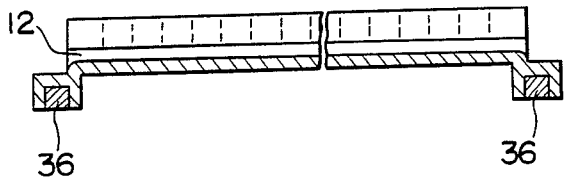

The noise silencing cover 12 made as of an AS resin is transparent to show the interior, and formed, as shown in FIG. 9, with grooves in portions thereof coming into contact with the front cover 2 of the printing apparatus which surround the cover 12 on three sides thereof and have fitted therein a filler 36 formed as of rubber having noise silencing and vibration damping effects. FIG. 9(B) shows in a cross section taken along the line X—X the noise silencing cover 12 shown in FIG. 12(A) which has a character scale 37 printed on a surface thereof juxtaposed against the sound absorber 8. Thus the platen 3 is covered at its top with the sound absorber 8 and noise silencing cover 12 so that the noise produced when printing is performed can be kept from being released to the outside.

Figure 4:
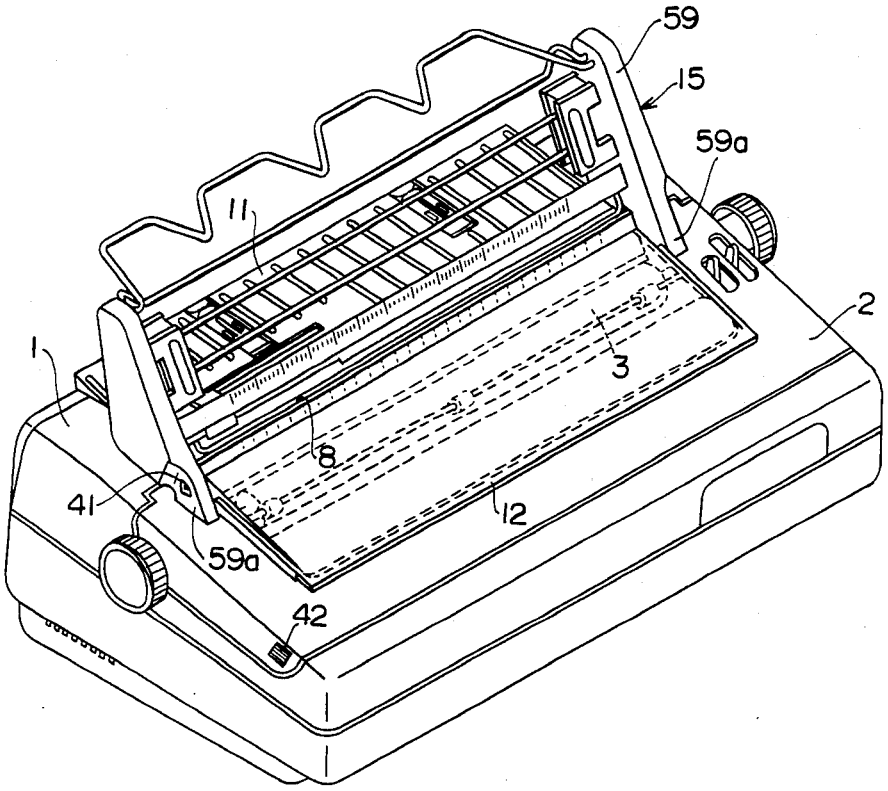
FIG. 4 is a perspective view of the printing apparatus shown in FIG. 3, having a page feeder mounted thereon.

FIG. 4 shows the impact printing apparatus shown in FIG. 3, shown with a page feeder 15 additionally mounted thereon. In this case, the printing sheet guide 11 is brought to a lying position by folding the legs, and blind plates 16 detachably attached to portions of the front cover 2 located outwardly of the sound absorber 8 and the arms 12*a* of the noise silencing cover 12 (see FIGS. 2 and 3) are detached (they can be readily removed upon opening the front cover 2 in the condition shown in FIG. 3) to enable engaging portions 59*a* of side covers 59 of the page feeder 15 to be inserted therein into engagement with a shaft of the platen 3.

Figure 12:
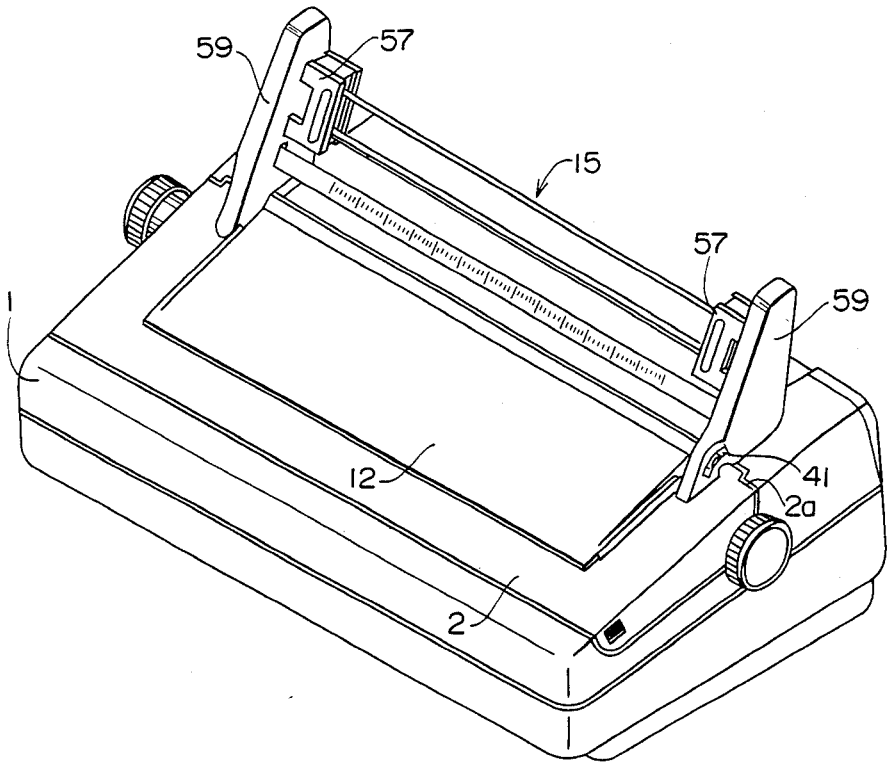
FIG. 12 is a perspective view of the page feeder.
Figure 13:
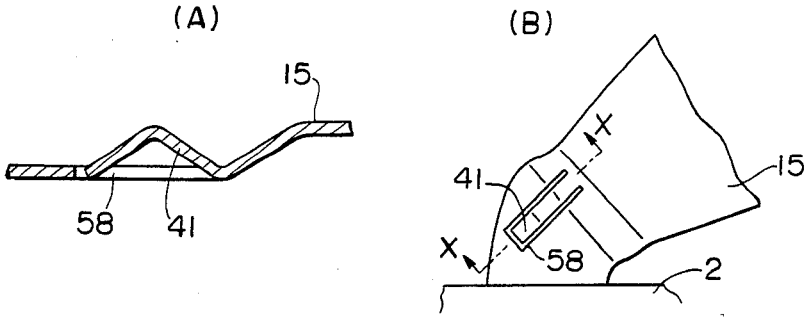
FIG. 13 is a view showing the construction of the principal portions of the page feeder.
Figure 15:
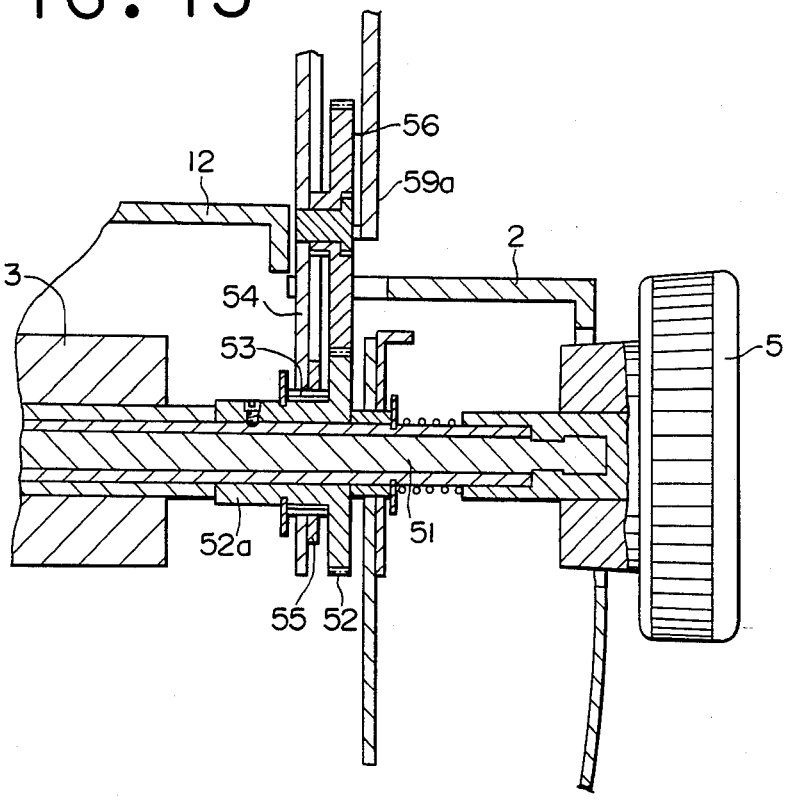
FIG. 15 is a view of the construction of the page feeder in engagement with the platen shaft.

The page feeder 15 includes tractors 57 for successively feeding sheets arranged continuously one after another as shown in FIG. 12. The side covers 59 have engaging portions at their forward ends which are inserted into the printer body in positions located at the front cover 2 outwardly of the tractors 57 and inwardly of hinged portions 2*a* of the front cover 2, to be brought into engagement with the shaft of the platen 3. The tractors 57 are driven through a transmission gearing in meshing engagement with a drive gear secured to the shaft of the platen 3. Portions of the side covers 59 inserted through the front cover 2 into the printer body have a relatively small thickness, so that it is possible to reduce the external dimensions of the printing apparatus without reducing the width thereof available for printing. The side covers 59 are each formed in a portion thereof above the portion inserted into the printer body with a locking claw 41 having resilience. The locking claws 41 are each formed, as shown in FIG. 13, when one of the side covers 59 are made of resin, in the shape of a strip surrounded on three sides by cuts 58 and bent in wave form in cross section. The locking claws 41 can make use of the resilience of the resin by virtue of the cuts made on three sides of the strip. The locking claws 41 are formed on the side covers 59 on the opposite sides of the page feeder 15. FIG. 13(A) is a sectional view taken along the line X—X in FIG. 13(B).

Figure 14:
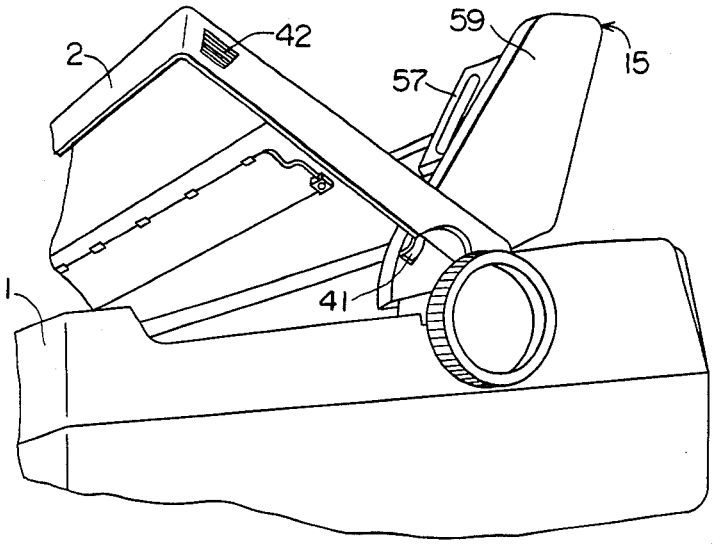
FIG. 14 shows the page feeder shown in FIG. 12, shown in another condition of use.

When it is desired to replace the ribbon or the printing wheel by a new one in the embodiment of the invention having the optional components mounted thereon, the front cover 2 can be brought to an open position by the operator gripping knurled portions 42 formed on opposite sides of the cover 2, as shown in FIG. 14. At this time, inner side edges of the front cover 2 move past the locking claws 41 formed on the side covers 59 of the page feeder 15 and engaged thereby, so that the front cover 2 catches against the locking claws 41 and is held and locked thereby even if the hands of the operator are removed from the knurled portions 42. The locking claws 41 are flexed when the inner side edges of the front cover 2 move past them but restored to their original positions by their resilience. When it is desired to bring the front cover 2 to a closed position, the operator has only to push the front cover 2 lightly downwardly. This causes the engaging claws 41 to flex, thereby allowing the front cover 2 to move downwardly.

When the page feeder 15 is mounted on the printer body, a drive gear 52 secured to a shaft 51 of the platen 3 has a support ring 53 loosely fitted over a shaft portion 52*a* of the drive gear 52, and a forward end portion of a frame 54 of the page feeder 15 is in engagement with the support ring 53 and latched by a latch lever 55. At this time, a gear 56 on the frame 54 meshes with the drive gear 52, so that motive force is transmitted from the drive gear 52 to the page feeder 15 through the series of gears described hereinabove. When the page feeder 15 is not mounted, the blind plates 16 are fitted in the openings at the front cover 2. When these openings for the engaging portions are open at all times, noise may leak therethrough and the interior of the printer is undesireably exposed.

Figure 5:
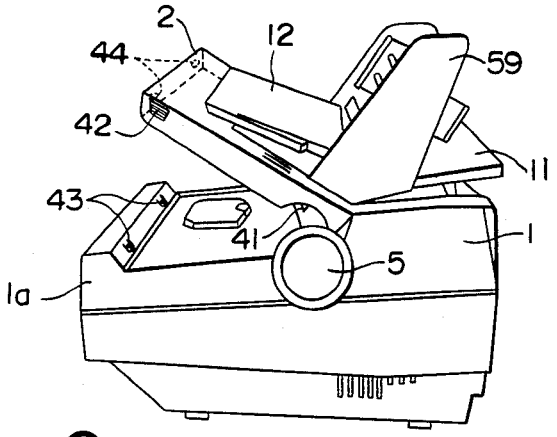
FIG. 5 is a view of the printing apparatus shown in FIG. 4, showing the apparatus mounting the optional components and having the front cover removed to an open position.

From the foregoing description, it will be appreciated that according to the invention the page feeder 15 can be mounted on the impact printing apparatus while the sound absorber 8, printing sheet guide 11 and noise silencing cover 12 are already mounted (or without these components mounted), and that the front cover 2 can be opened, as shown in FIG. 5, without removing the optionally mounted components. Moreover, when the front cover 2 is opened, it can be locked in place by bringing it into engagement with the locking claws 41 located in positions on the side covers 59 of the page feeder 15 above the engaging portions 59*a*.

Figure 10:
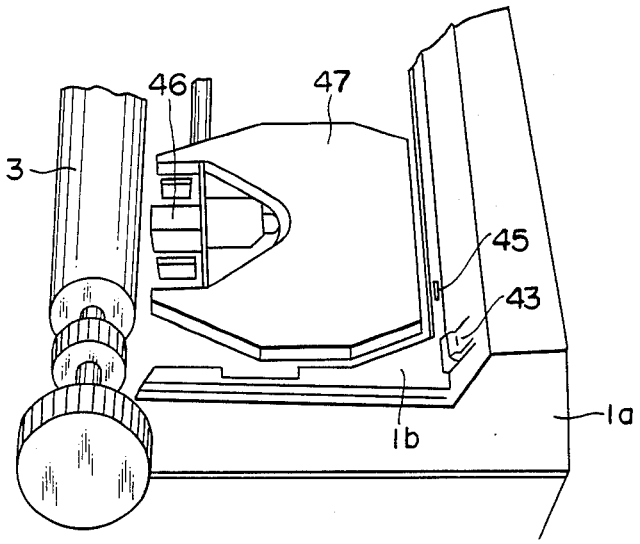
FIGS. 10 and 11 are perspective views of the internal mechanism arranged below the front cover.
Figure 11:
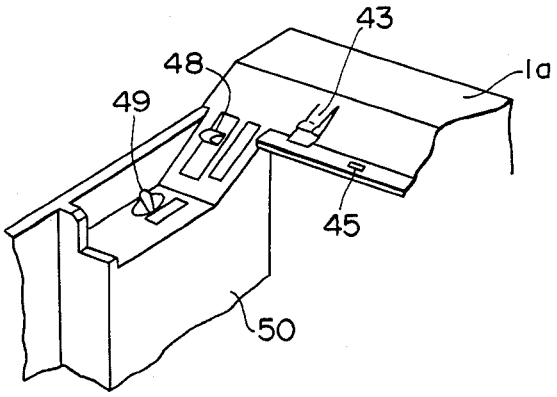

It is necessary to open the front cover 2 when the printing wheel and the ribbon are replaced by new ones or a switch or a key is actuated. When it is brought to a closed position, it is locked in position as locking claws 43, having resilience and formed integrally with the upper cover 1 on an inner side of a front bar 1*a* of the upper cover 1 as shown in FIG. 5, are brought into engagement with square openings 44 formed at the front cover 2 in positions corresponding to the positions of the locking claws 43 as shown in FIGS. 10 and 11. The locking claws 43 do not stick out of the cover and there are no risks of the fingers being caught thereby. The provision of a rubber member in the vicinity of the locking claw 43 prevents noise from being made by friction between the covers due to vibration and gives a fine feel to the operator when the front cover 2 is locked in position.

When the front cover 2 is brought to an open position, a printing section supported by a carriage is revealed, as shown in FIG. 10. The printing section has a printing hammer 46 juxtaposed against the platen 3, a printing wheel, not shown, attached to a front surface of the printing hammer 46 and a ribbon cassette 47 mounted on the printing hammer 46. The upper cover 1 includes an inner edge portion 1*b* formed to conform to the external shape of the ribbon cassette 47 when the printing section is in its starting position. This makes the apparatus look neat and stable. The printing section further has located at one side an operation lever 48 and a switch 49 for regulating the spacing between the platen 3 and printing hammer 46 depending on the thickness of printing sheets as shown in FIG. 11. Mechanical portions actuated by the lever 48 and switch 49 are enclosed by a cover 50 formed unitary with the upper cover 1, to separate the mechanical portions from the other portions.

From the foregoing description, it will be appreciated that the invention enables optionally mounted components including the printing sheet guide, sound absorber, noise silencing cover and page feeder to be mounted on a printing apparatus all at once or in any combination as desired. Moreover, these components can be mounted or removed quite readily in one operation. Thus regardless of whether the printing sheet guide and page feeder are mounted, release of noise to the outside can be avoided by mounting the sound absorber and noise silencing cover so that the apparatus makes little noise. Since the front cover can be opened and closed without requiring removal of the optional components, it is possible to carry out replacing of the printing wheel and ribbon without any trouble. This eliminates the trouble of the prior art of detaching the optional components and attaching them again when the need to replace the printing wheel or ribbon arises, and the need to look for some place for temporarily depositing the detached components is also eliminated. The printing sheet already set in the printing apparatus is not adversely affected by the operation of opening and closing the front cover and noise silencing cover, so that the need to reinsert a printing sheet experienced in a printing apparatus of the prior art can be eliminated. The maximum width of printing sheets that the printing apparatus can handle when the optional components are mounted is the same as when no optional components are mounted. When the printing sheet guide and page feeder are mounted in combination, the printing sheet guide is brought to a lying position. However, a space is created between a ventilating opening formed on a top surface of the upper cover and a heat sink on a rear surface of the printer body to thereby avoid a rise in the internal temperature of the printing apparatus that might otherwise be caused when the ventilating opening is blocked by the sheets. When no optional components are mounted, the brackets used for mounting the printing sheet guide and noise silencing cover can be readily removed, thereby giving a neat external appearance to the printing apparatus. Thus the need to use separate printing apparatus suiting the particular optional component or components is eliminated by the invention which provides a printing apparatus of high versatility and economical value.

Figure 16:
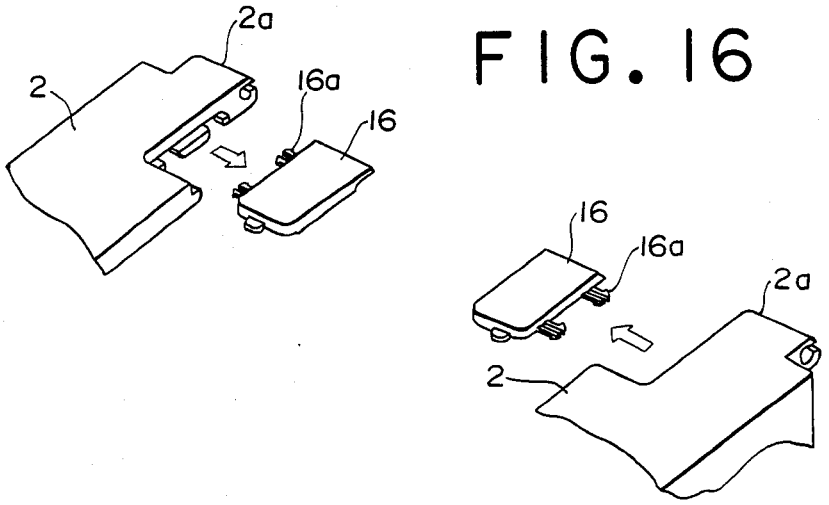
FIG. 16 is a view of the blind plates attachable to the front cover.

The blind plates 16 detachably attached to the front cover 2 in positions inwardly of the hinged portions 2*a* of the front cover 2 are each formed, as shown in FIG. 16, with resilient claws 16*a* adapted to come into engagement with engaging portions formed at the front cover 2. Thus by pulling the blind plates 16 in the direction of an arrow, they can be readily detached from the front cover 2, and they can be attached thereto by pushing in an opposite direction. When no page feeder is mounted, the blind plates 16 are left in position as shown in FIG. 3.

When the page feeder 15 is desired to be mounted on the printing apparatus shown in FIG. 4, the blind covers 16 are detached from the front cover 2 and the forward ends of the side covers 59 of the page feeder 15 having the engaging portions 59*a* are inserted in the corresponding openings formed at the front cover 2 to bring the engaging portions 59*a* into engagement with the shaft of the platen 3. Thus the openings formed by the removal of the blind plates 16 are closed by the side covers 59 of the page feeder 15. In the present invention, the page feeder 15 can be mounted merely by bringing the printing sheet guide 11 to a lying position without requiring its removal.

The front cover 2 of the printing apparatus according to the invention is constructed as described hereinabove. The blind plates 16 are left in position when no page feeder is mounted, and the openings formed at the front cover 2 by the removal of the blind plates 16 can be closed by the side covers 59 of the page feeder 15, thereby avoiding release of noise to outside.

Figure 17:
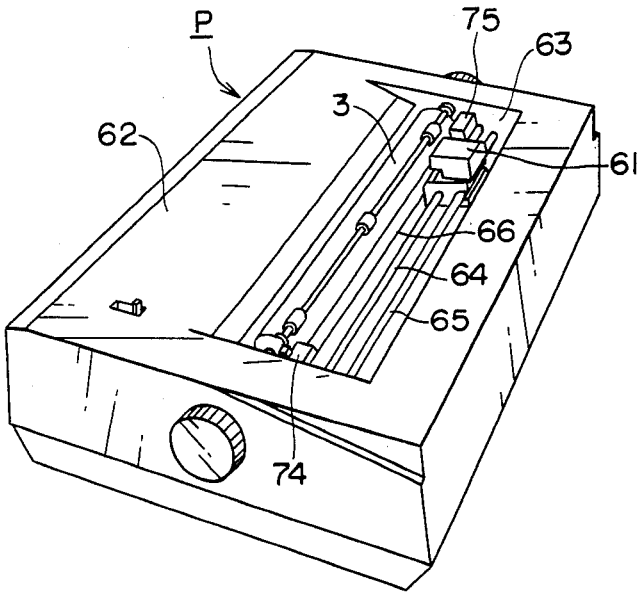
FIG. 17 is a perspective view of the carriage section of the printing apparatus.
Figure 18:
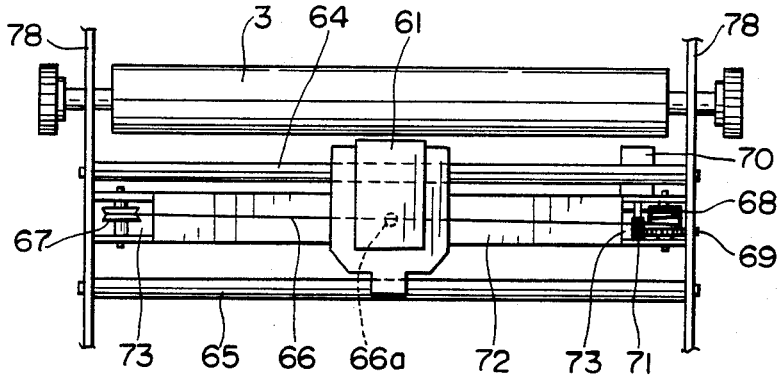
FIG. 18 is a plan view showing the condition in which the wire for moving the carriage is mounted.
Figure 19:
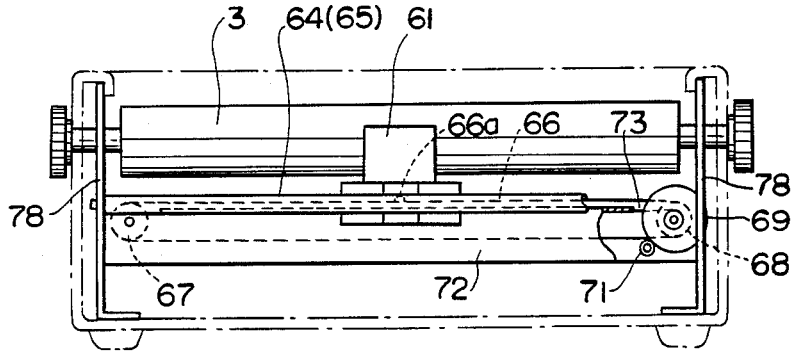
FIG. 19 is a front view showing the carriage moving wire.

In a printing apparatus, such as the one designated by P in FIG. 17, a carriage 61 supporting a printing section is usually exposed to view in an opening 63 of a printer body 62. The carriage 61 is pulled along guides 64 and 65 located parallel to the platen 3 by a wire 66 trained over pulleys 67 and 68 supported by shafts in a region defined between the two guides 64 and 65, as shown in FIGS. 17 and 18.

The pulley 68 mounts a gear 69 which is in meshing engagement with a pinion 71 on a motor 70.

In the aforesaid construction, the wire 66 is an endless wire which is wound in several turns on the pulley 68 on the drive side, and the tensioned wire 66 is secured midway to the carriage 61 by a screw as indicated at 66*a*.

Mounted between the guides 64 and 65 in a manner to enclose the pulleys 67 and 68 and support same by shafts while keeping the wire 66 tensioned is a frame 72 which is substantially in the form of a letter U in an inverted position in cross section and formed at its top wall with openings 73 in positions corresponding to the positions of the pulleys 67 and 68 to allow upper end edges of the pulleys 67 and 68 to stick slightly upwardly out of the openings 73 to enable a top surface of the wire 66 to come into contact with the carriage 61.

In view of the function of the printing apparatus P to carry out printing on a sheet supported by the platen 3, the opening 63 in the apparatus P is left uncovered at all times. This might result in dust or the hair of operator being deposited on the pulley 67 and 68. When such foreign matter is deposited on the pulleys 67 and 68, the printing positions of the carriage 61 which require high accuracy and precision would be displaced, causing a change to occur in spacing. More specifically, if some foreign matter enters between the wire 66 and the pulleys 67 and 68 maintained in intimate contact with each other, the wire 66 would be pulled excessively in either direction, causing a change to occur in the amount of movement of the carriage 61 which is moved at high speed for performing printing.

To obviate the aforesaid trouble of the prior art, the invention provides wire pulley covers which, by preventing the occurrence of the aforesaid trouble of the prior art, enable printing to be performed with a high degree of accuracy.

Figure 20:
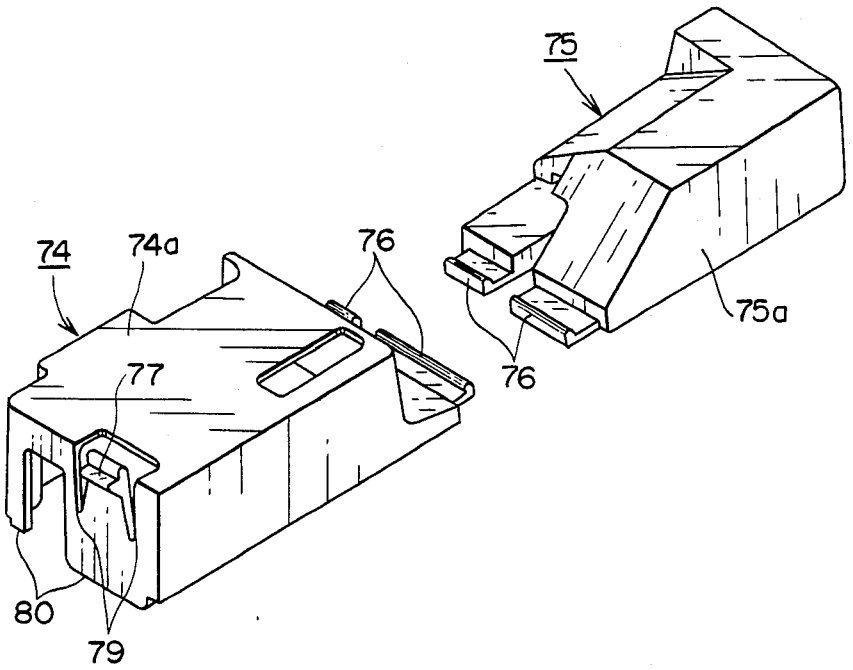
FIGS. 20 and 21 are perspective views, on an enlarged scale, of the cover for the wire pulleys, viewed from different directions.
Figure 21:
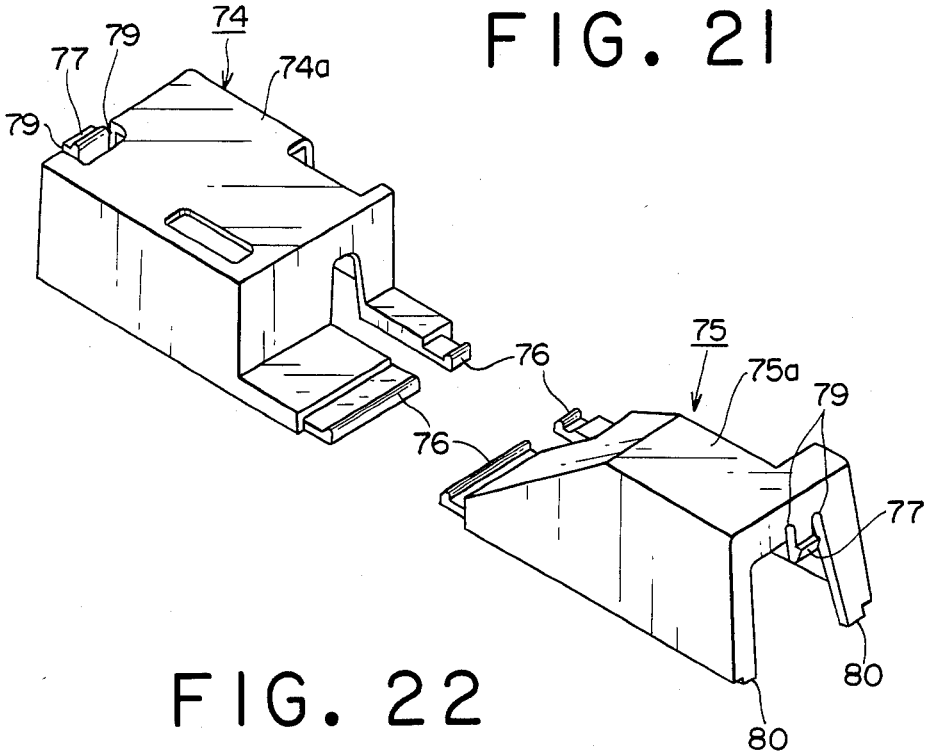

FIGS. 20 and 21 show one embodiment of the wire pulley covers in accordance with the invention in which the numerals 74 and 75 designate covers for the pulleys 67 and 68 respectively. The covers 74 and 75 which are formed of a synthetic resinous material are detachably attached to the openings 73 formed in the frame 72 supporting the pulleys 67 and 68 by shafts. The covers 74 and 75 comprise, respectively, cover bodies **74*a* and 75*a* large enough to be located astride the pulleys 67 and 68 sticking upwardly out of the frame and the wire 66 trained over the pulleys 67 and 68. The covers 74 and 75 each include engaging claws 76 and 77 attached to the cover body 74*a*, 75*a* at opposite ends for positioning the cover body 64*a*, 75*a* in an opening 73 formed in the frame 72**.

Figure 22:
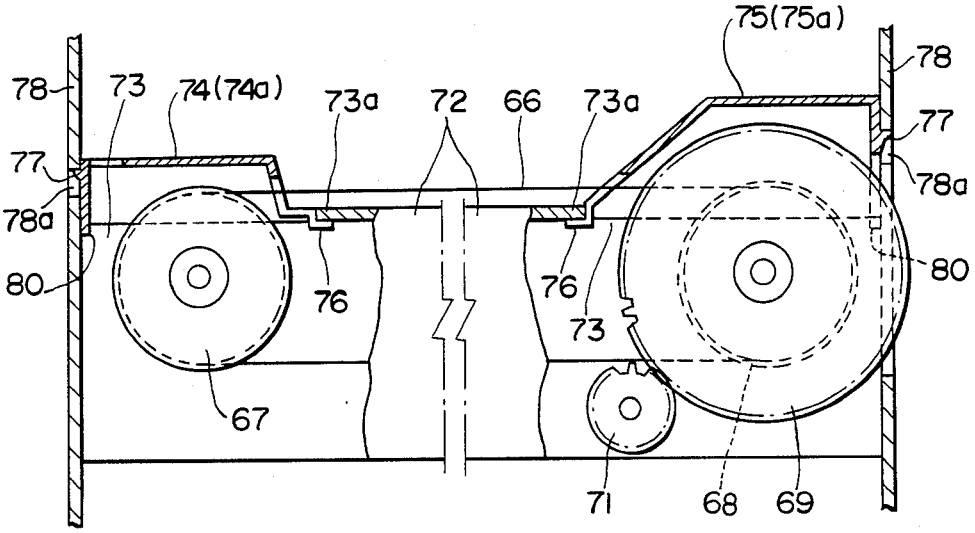
FIG. 22 is a sectional view of the essential portions showing the condition in which the covers for the wire pulleys is mounted.

As shown in FIG. 22, the engaging claws 76 are in engagement with an edge portion **73*a* of the frame 72 defining the opening 73, and the engaging claws in engagement with an edge portion of a frame 78 defining an opening 68*a*. Slits 79 are formed along the engaging claw 77** to allow the claw to resiliently move rearwardly.

Thus the covers 74 and 75 can be attached to the frame 72 to close the openings 73 in positions near corners of the frames 72 and 78.

The engaging claws 76 of the covers 74 and 75 each have a width which is commensurate with the inner dimension of the frame 72, and the engaging claw 77 has a downwardly extending portion 80 which is commensurate with the frame 72 in dimension, to avoid transverse displacement of the covers 74 and 75 following their attaching to the frame 72 to close the openings 73 therein to protect the pulleys 67 and 68 from dust and other foreign matter.

In the embodiment shown in the drawings, the covers 74 and 75 are slightly distinct from each other in shape. However, the invention is not limited to this specific difference in the shape of the covers 74 and 76 and they may be of the same shape and each may be symmetrical on the right and left. When this symmetrical construction is adopted, the carriage 61 should, of course, be shaped such, by taking into consideration the structural relationship of the elements of the printing section, that the carriage 61 is kept from contacting the covers 74 and 75.

By providing the covers 74 and 75 of the aforesaid construction for the wire pulleys 67 and 68, it is possible to readily set in positions above the wire pulleys 67 and 68 the covers 74 and 75 so as to protect the latter from dust to enable them to perform their functions satisfactorily.

The covers 74 and 75 are formed with the engaging claws 76 and 77 enabling them to be readily attached and detached from the cover 72 of the wire 66. This arrangement allows the covers 74 and 75 to be readily removed when it is desired to inspect the interior of the printing apparatus or effect adjustments of the elements of the printing section.

An additional advantage of the covers 74 and 75 is that they can be set in place in the printing apparatus by utilizing the openings 73 formed in the frame 72 for the wire 66, without requiring to provide a special mounting structure at the printer body. This eliminates a complex working on the printer body and is conducive to reduced cost.

What is claimed is:

1. A printing apparatus comprising:

a printer body;

an upper cover secured to said printer body;

a front cover attached to the printer body by hinged portions on opposite sides of the front cover in a position forwardly of said upper cover and movable between an open position and closed position;

a platen interposed between said upper cover and said front cover;

means to selectively mount one or more of a group of components including a sound absorber, a printing sheet guide, a noise silencing cover and a page feeder;

a pair of brackets each removably inserted in one of two engaging holes formed on opposite sides of said upper cover, each of said brackets having a first engaging portion located on an inner side of said bracket and a second engaging portion located on an outer side of said bracket;

said sound absorber detachably inserted along said platen;

said printing sheet guide releasably brought into engagement at corners on opposite sides with said first engaging portions of said brackets so that the printing sheet guide can be set in a predetermined position or brought to a lying position when not in use;

said noise silencing cover releasably brought into engagement at forward ends of arms located on opposite sides of said noise silencing cover with said second engaging portions of said brackets to thereby cover a printing section in a manner to be freely opened and closed; and said page feeder including engaging portions located on opposite sides of said page feeder which are inserted in positions at the front cover outwardly of the sound absorber and the noise silencing cover and inwardly of said hinged portions in such a manner that said engaging portions are releasably brought into engagment with a shaft of said platen;

wherein said components to be optionally mounted on the printing apparatus can be mounted either singly or plurally in any arbitrarily selected combination as desired, and the front cover can be brought to an open position without removing the optionally mounted component or components for replacing a ribbon or a printing wheel with a new one.

2. A printing apparatus as claimed in claim 1, further comprising a pair of blind plates each detachably attached in one of said positions at said front cover in which one of said engaging portions is inserted, said blind plates being removed from their positions when the page feeder is mounted on the printing apparatus.

3. A printing apparatus as claimed in claim 1, wherein said page feeder includes side covers each formed with a locking claw having resilience and projecting in angled form from the surface of the side cover, said locking claws being brought into locking engagement with inner side edges of said front cover when the front cover is brought to an open position.

4. A printing apparatus as claimed in claim 1, further comprising a printing section located in the printer body and supported on a carriage, a pair of wire pulleys for driving the carriage supported by a frame, and a pair of covers detachably attached to said frame to close openings for the wire pulleys to slightly extend upwardly therethrough.

* * * * *